United States Patent [19]

Potter

[11] Patent Number: 4,637,440

[45] Date of Patent: Jan. 20, 1987

[54] VENTLESS LIQUID RECOVERY SYSTEM FOR PRESSURIZED GAS LINES

[76] Inventor: Troy J. Potter, 200 Bailey, Dumas, Tex. 79029

[21] Appl. No.: 727,243

[22] Filed: Apr. 24, 1985

[51] Int. Cl.[4] ..... B65B 3/04; B65B 31/04

[52] U.S. Cl. ..... 141/65; 141/59; 141/37; 137/203

[58] Field of Search ..... 141/59, 60, 65, 66, 141/98, 231, 44, 45, 37; 137/205, 203; 417/34

[56] References Cited

U.S. PATENT DOCUMENTS

| | | | |
|---|---|---|---|
| 2,552,518 | 5/1951 | Churchman | 137/203 |
| 3,438,409 | 4/1969 | Bruce et al. | 141/59 |
| 3,465,767 | 9/1969 | Peres | 141/59 |
| 3,621,893 | 11/1971 | Nishimura et al. | 141/65 |
| 3,727,651 | 4/1973 | Biever | 141/231 |
| 3,756,266 | 9/1973 | Artz | 137/203 |
| 3,971,400 | 7/1976 | Thompson | 137/205 |
| 4,057,364 | 11/1977 | Bratschitsch | 417/34 |
| 4,082,124 | 4/1978 | Jenkins | 141/65 |
| 4,227,893 | 10/1980 | Shaddock | 55/430 X |
| 4,456,039 | 6/1984 | van der Lely et al. | 141/98 |
| 4,483,376 | 11/1984 | Bresie et al. | 141/95 |
| 4,531,558 | 7/1985 | Engel et al. | 141/44 |

FOREIGN PATENT DOCUMENTS

| | | | |
|---|---|---|---|
| 0101199 | 6/1982 | Japan | 141/66 |

*Primary Examiner*—Stephen Marcus
*Assistant Examiner*—Ernest G. Cusick
*Attorney, Agent, or Firm*—Harvey B. Jacobson

[57] ABSTRACT

A first low pressure storage tank is provided including a liquid inlet and a valved liquid outlet as well as a vapor outlet. Gas pump structure is also provided including suction and discharge ports and a high pressure storage tank is provided including a gas inlet and a gas outlet. First pipe structure is provided including an inlet end for communication with the liquid trap or sump of a gas transmission pipe line and an outlet end communicated with a gas inlet for the low pressure storage tank. A second pipe communicates the vapor outlet of the low pressure tank with the suction port of the gas pump and a third pipe communicates the discharge port of a gas pump with the gas inlet for the high pressure tank. Further, the second pipe includes a gas/liquid separator including a valved out communicated with the first pipe and the high pressure storage tank includes a lower valved liquid outlet communicated with the first pipe.

16 Claims, 3 Drawing Figures

14

94
96
92
98
124
128
126
130
132
110
32
102
100
116
34
20
18
114
108
28'
134
30''
30
30'
28''
28
106
90
24
22
118
26
20
18
120
112
104
150
136
38
40
36
A
D
77
B
54
122
C
88
140
138
86
148
142
146
56
52
48
42
50
46
44

VENTLESS LIQUID RECOVERY SYSTEM FOR PRESSURIZED GAS LINES

BACKGROUND OF THE INVENTION (1) Field of the Invention

This invention relates to the recovery of liquid which accumulates in gas pipe line sump areas and the recovery of such liquids by a ventless process which may be effective to an extent representing a savings of approximately $7,000.00 per day for a major gas producer in the western panhandle, only, of the State of Texas.

(2) Description of the Related Art

Various different forms of pumping and valved devices heretofore have been provided for removing liquids from one container and discharging those liquids to a suitable drain or storage facility. Examples of various different forms of previously known structures of this type are disclosed in U.S. Pat. Nos. 2,552,518, 3,621,893, 3,756,266, 4,057,364, 4,082,124, 4,227,893 and 4,456,039.

However, these previously known structures are not designed to recover collected liquids from gas transmission piepline sump areas in a manner preventing escape of vapors from the gas line system, which vapors contain not only various gases but also considerable quantities of vaporized volatile liquids including butane and propane.

Accordingly, a need exists for a gas transmission pipeline sump liquid recovery system which will be capable of recovering liquids from gas transmission line sump areas in a manner such that all vapors generated as a result of such liquid recovery will be retained.

SUMMARY OF THE INVENTION

The recovery system of the instant invention incorporates both a method and apparatus for recovering liquid from gas transmission line sump portions in a manner such that the venting of considerable quantities of volatile vapors usually associated with such liquid recovery is eliminated.

In the panhandle area of the State of Texas there are approximately twenty-five major companies operating gas transmission lines which may vary in size from two inches to thirty inches in diameter. Many of these transmission lines traverse geographical areas which include alternating high and low elevation surface areas with the result that the gas transmission lines themselves include alternating high and low elevation portions.

Natural gases from gas wells include not only vaporized water but also vaporized highly volatile liquids such as propane and butane. Further, each of the low elevation portions of a gas transmission line must be provided with a sump for collecting liquids therein and means for repeatedly extracting liquids which accumulate in the sump in order to maintain the gas transmission lines unobstructed for the free passage of gas therethrough.

In addition, some gas transmission lines incorporate pumping stations for promoting the rapid flow of gas therethrough, the gas being increased in pressure at such a pumping station and being returned to an associated gas transmission line may be at an elevated temperature of approximately 180° F. If the downstream portion of such a gas transmission line extending from the pumping station traverses alternating low and high elevation terrain areas there may be as many as fifty sump portions incorporated into the downstream portion of the gas transmission line in a five mile distance.

The need for this many sump portions arises in view of the cooling of the gas discharged into the downstream portion of the gas transmission line from approximately 180° F. to 55° F., or less, which cooling results in a considerable amount of condensation of water from the gas being transmitted as well as perhaps even greater quantities of butane and propane gas condensing out on the side walls of the pipeline together with appreciable quantity of condensed natural gas liquids, crude oil, drip, casinghead gasoline, natural gasoline and/or other liquids.

Conventional liquid recovery methods involve communication of pipeline sump portions or areas with the interiors of tank truck tanks and in most instances the existing gas line pressure is sufficient to elevate the liquid from the gas transmission line sump portion into the tank of the tank truck, which tank is vented to prevent excess build up of pressure therein. However, although substantially all of the water extracted and much of the heavier other liquids from the pipeline sump portion is retained within the tank of the tank truck, the reduction of pressure of the condensed butane and propane liquid as well as other volatile liquids allows the latter to substantially immediately vaporize and the butane and propane gas is vented from the tank truck tank.

It has been estimated that the extraction of liquid from gas line sumps by a single company operating gas transmission lines in the panhandle of the State of Texas experiences the loss of vaporized gases such as butane and propane and other volatile liquids in an amount having a value in excess of $7,000.00 per day, over the cost of liquid recovery by the apparatus and method of the instant invention. In addition, the recovery of these liquids by the instant invention eliminates the venting of poison and highly flammable gases into the atmosphere, which venting in the past has caused deaths of truck operators by both asphyxiation and explosion.

The main object of this invention is to provide a method and apparatus for recovering liquid from gas transmission line sump areas in a manner such that the venting of gases by the recovery apparatus is eliminated.

Another object of this invention is to provide a recovery system in accordance with the preceding objects and which may be provided and operated at little more expense than that involved with conventional liquid recovery systems.

A further object of this invention is to provide a liquid recovery system for gas transmission line sump areas and utilizing a mobile tanker including features whereby liquids collected and retained thereby may be transferred to tank truck shuttles or to other vessels.

A still further object of this invention is to provide a gas transmission line liquid recovery apparatus which may be readily operated by personnel presently operating conventional liquid recovery equipment with only minimun additional instruction.

A final object of this invention to be specifically enumerated herein is to provide a gas transmission line liquid recovery system which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
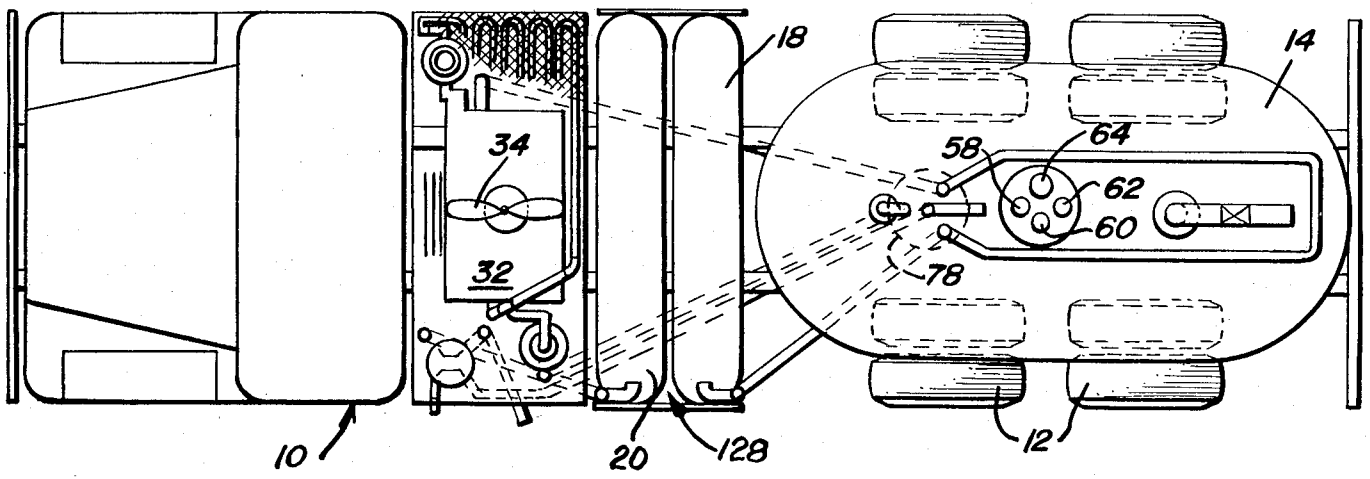
FIG. 1 is a top plan view of a liquid recovery tank truck constructed in accordance with the present invention.
Figure 2:
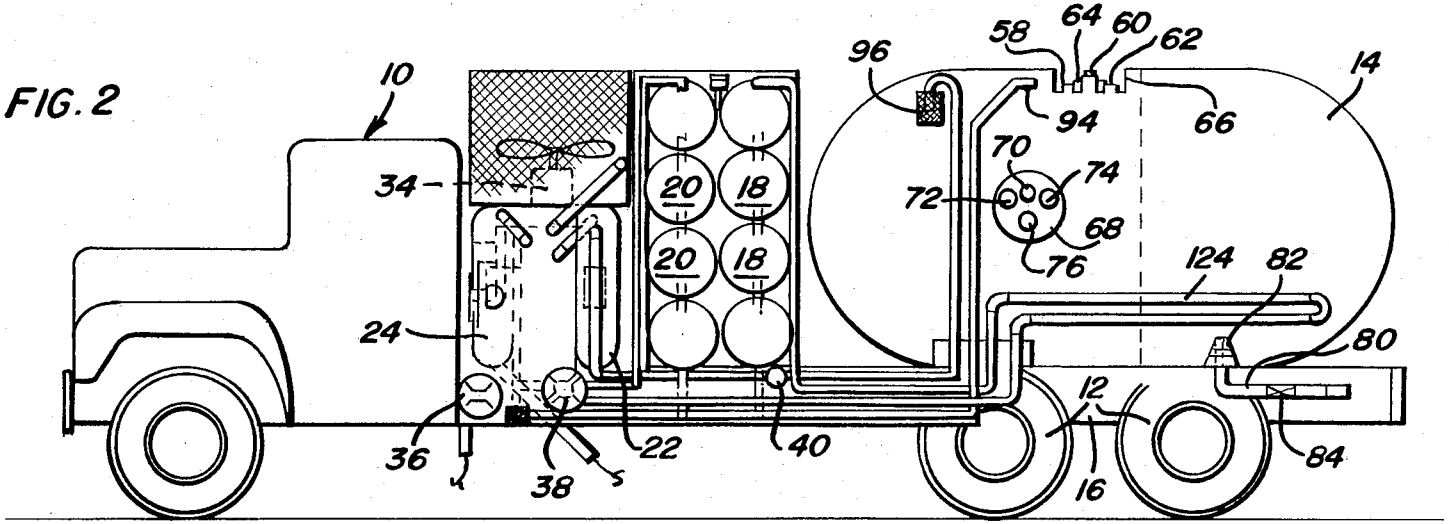
FIG. 2 is a side elevational view of the tank truck.
Figure 3:
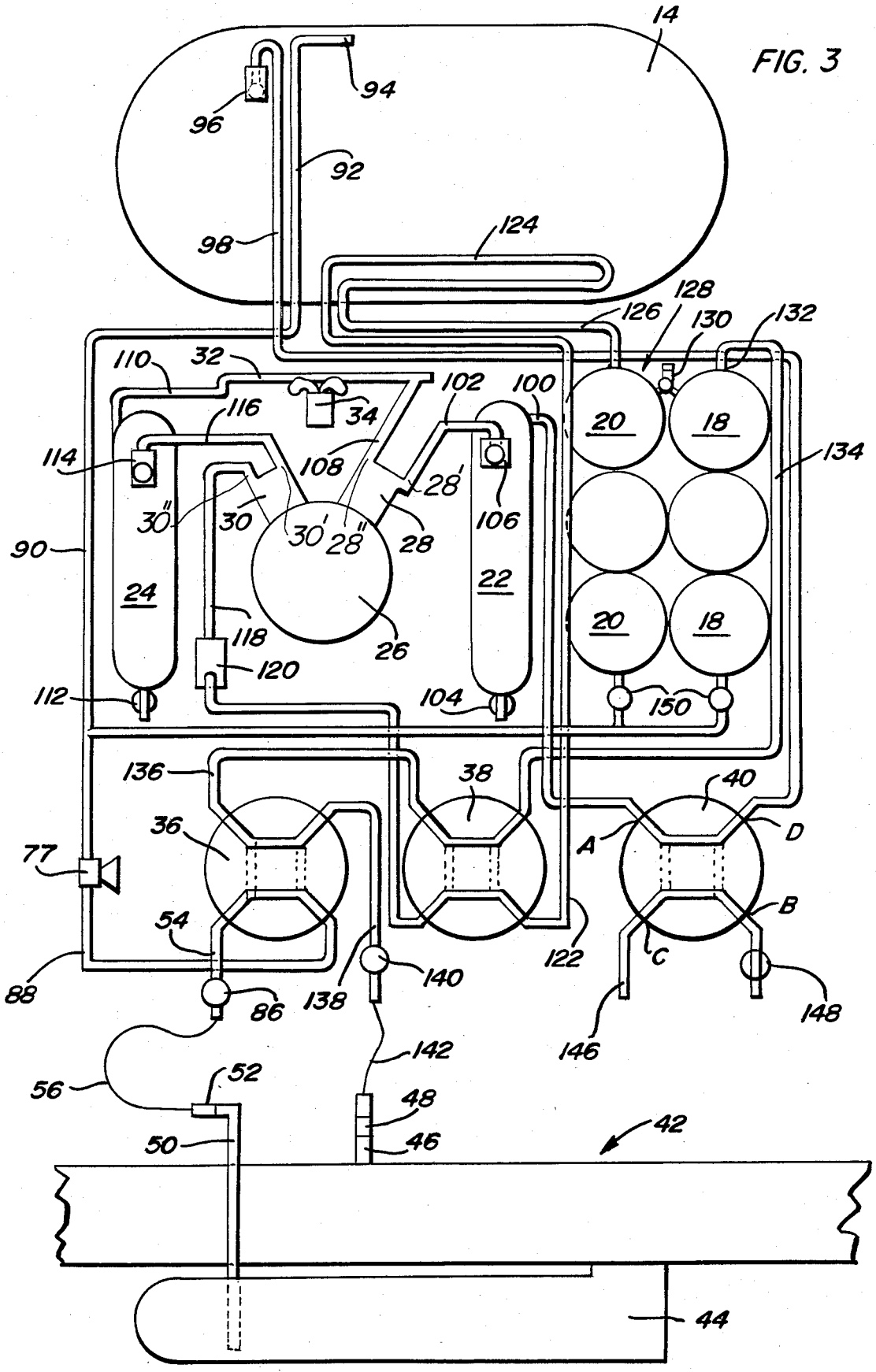
FIG. 3 is a diagramatic view illustrating the various liquid and gas flow handling components of the instant invention.

Referring now more specifially to the drawings the numeral 10 generally designates a heavy duty tank truck which may be powered by a diesel engine (not shown) having a power take off (not shown) operatively associated therewith. The tank truck 10 includes dual tandem axels 12 and a large capacity medium pressure tank 14 mounted on the rear portion of the frame 16 of the truck 10. In addition, the truck 10 mounts two interconnected sets of very high pressure tube tank structures 18 and 20 therefrom closely forward of the tank 14. The tanks 18 are interconnected and the tanks 20 are interconnected. Also the truck 10 includes a pair of liquid/gas collectors separators 22 24 mounted therefrom forward of the tanks 18 and 20, gas pump structure in the form of air compressor 26 including first and second stages 28 and 30 and a heat exchanger 32 with which a fan assembly 34 is operatively associated.

The first stage 28 includes an inlet or suction port 28' and a discharge port 28'' while the second stage 30 includes an inlet or suction port 30' and a discharge port 30''. The recovery system also includes three four way valves 36, 38 and 40.

A gas transmission pipeline is referred to in general by the reference numeral 42 and includes a liquid sump, trap or "drip" 44 at each low elevation of the pipeline 42 disposed intermediate adjacent high elevation portions of the pipeline 42. Water and various gases in liquid form collect within the "drip" 44 and msut be removed therefrom before the "drip" 44 is filled and the excess liquid totally occupies the interior of the low elevation portion of the piepline 42 causing a blockage to the flow of gas through the pipeline 42.

The pipeline 42 may include a riser 46 under the control of a valve 48 and the sump or "trap" 44 includes a riser or discharge line 50 under the control of a valve 52. The truck 10 includes an intake pipe or conduit 54 to which the riser 50 may be connected by a pressure hose or conduit 56.

The tank 14 includes two pressure relief valves 58 and 60, a rupture disk 62 and an air actuated, operator controlled vent valve 64, all of which are mounted within a recessed manway 66 formed in the upper central portion of the tank 14. In addition, the tank 14 further includes a side recessed gauge area 68 in which is mounted a pressure gauge 70, a temperature gauge 72, a liquid level indicator 74 and a pressure sensitive actuator 76 used in conjunction with a pressure limiting valve 77 to limit maximum pressure inside the tank 14 in a manner to be hereinafter more fully set forth. Also, it will be noted that the forward lower portion of the tank 14 additionally includes an upwardly recessed manway 78 through which various lines or conduit open into the interior of the tank 14 and the rear lower portion of the tank 14 includes a drain pipe or liquid outlet structure 80 connected with the tank 14 by a remote operated emergency shut off valve 82 with fusable safety link (not shown) and a manual valve 84 for use in transferring liquids from the tank 14 to tank truck shuttles or to other vessels.

In operation, the vehicle 10 is driven by the operator to a geographic location where natural gas liquids are known to collect in a sump such as the trap or sump 44. At this location the pipe riser 50 is connected to the four way valve 36 through the high pressure hose or conduits 56 and the intake pipe or conduit 54 through a valve 86. The four way valve 36 is manually placed in the "load" position and liquids from the trap 44 move through the valve 36 into pipe or conduit 88 in which pressure limiting valve 77 is serially connected and the liquid then passes through the valve 77 and into and through pipe or conduit 90 which passes upwardly through the manway 78 and terminates in a riser or liquid inlet structure 92 discharging into the interior of the tank 14 at a high elevation therein as at 94. By discharging the liquid into the tank 14 at 94 at a level above the liquid content of the tank 14, agitation of liquids within the tank 14 is avoided and any water which could remain within pipe or conduit 88 or pipe or conduit 90, or backflow into those pipes or conduits after the system has been shut down, may be blown into the tank 14, thus preventing freeze up of pipes or conduits 88 and 90.

Compresser or gas pump structure 26 is then activated using the engine of the vehicle to drive the compressor or gas pump structure 26. Vapors within the interior of the tank 14 are then evacuated therefrom through a floating ball stop valve 96 and pipe or conduit 98 connected to four way valve 40. The vapor then passes through the four way valve 40 and into pipe or conduit 100 for subsequent discharge into the first collector 22 in which liquids are removed from the vapor stream before the vapors enter the first stage 28 of the compressor or air pump 26 through pipe or conduit 102. These liquids are removed from the collector 22, by the operator, periodically through manually operable outlet valve 104. The vapors moving from the collector 22 into the pipe or conduit 102 move through a floating ball stop valve 106 and into the first stage 28 of the compressor or gas pump 26. The vapors are heated by compression in the first stage 28 and are discharged therefrom through a pipe or conduit 108 to the inlet side of the condenser or heat exchanger 32 cooled by the fan assembly 34.

The vapors then move through pipe or conduit 110 into the second collector 24, which occasionally may be drained through outlet valve 112, wherein any liquids which may have condensed during the cooling step in the condenser 32 are retained. The vapors thereafter move outwardly of the collector 24 through a floating ball stop valve 114 and pipe or conduit 116 into the second stage 30 of the compresser or air pump 26. The vapors then are discharged from the compresser or air pump 26 at high pressure through pipe 118 having a check valve 120 serially connected therein and enter the four way valve 38. The high pressure vapors then pass through pipe or conduit 122 into an after cooler 124 disposed in the bottom of the tank 14 and thereafter exit the after cooler 124 through pipe or conduit 126 and enter the high pressure tank battery referred to in general by the reference numeral 128 and including interconnected tanks 18 and 20. The tank battery 128 includes a high pressure relief valve 130 for relieving excess pressure, when necessary. The high pressure gas is stored within the tank battery 128. The tank battery 128 includes a high pressure outlet 132 opening into pipe or conduit 134 and the pipe or conduit 134 is connected to the four way valve 38 and the latter is connected to the four way valve 36 by pipe or conduit 136. The high pressure gas may be discharged from the tank battery 128, through pipe or conduit 134, valve 38, pipe or conduit 136, valve 36 and through pipe or conduit 138 having a valve 140 serially connected therein. The pipe or conduit 138 is connected to the pipe riser 46 by a high pressure hose 142. High pressure gas stored in the tank battery 128 is retained by valve 140 during the surge mode system operation.

During surge mode operation, when gas pressure in tank battery 128 reaches an optimum pressure four way valve 36 is moved by the operator to the back flow position. Stored high pressure gas then moves from battery 128 through pipe or conduit 134, four way valve 38 in storage position, four way valve 36 in back flow position, pipe or conduit 54, valve 86, hose or conduit 56 and riser 50 into the trap 44. This gas will bubble up through any liquids remaining in the trap 44 and return to the main gas transmission line 42. When pressure in the tank battery 128 is lowered to minimum, four way valve 36 is moved by the operator to the load position and the process is repeated until trap 44 is empty or tank 14 is full.

During constant flow mode operation, which utilizes valve 48 and riser 46, pressure from the tank battery 128 is discharged continually through pipe or conduit 132, four way valve 38 in the storage position, four way valve 36 in the load position, into pipe or conduit 138, through block valve 140 and into riser 46 through valve 48. This gas, of course, reenters the gas transmission pipeline 42 above the trap 44. This method requires less horse power, less cooling and loading is much faster than the surge type method. Also, at locations having an injector valve such as valve 48 and riser 46, vehicles may be operated without the tank battery 128 or by using four way valve 38 in the bypass position to bypass cooler or heat exchanger 124 and tube tank battery 128 and allow the gas to flow from the high pressure discharge of the compressor through check valve 120, four way valve 38 in bypass position, through four way valve 36 in load position, through pipe or conduit 138 valve 140 and valve 48 in the riser 46. In this manner, the high pressure gas will be discharged substantially directly from the compressor gas pump structure 26 into the gas transmission pipeline 42 above the trap 44.

The four way valve 40 is interposed in pipe or conduit 100 so that in system alternate position vapors are evacuated from tank 14, through floating ball stop valve 96, through pipe or conduit 98 and into port D of four way valve 40. The vapors then pass out of port A of valve 40 into the first liquid/gas separator 22 through pipe or conduit 100 and on through the rest of the system as previously described. Ports C and B are blanked in this mode of operation. With four way valve 40 in external position vapors may be moved from an outside source such as another tank truck (shuttle) into port C (having an outside connection 146 through four way valve 40,) out port A and into the first liquid/gas separator 22, etc. During this alternate mode of operation of four way valve 40, port B is closed using valve 148, which seals pipe or conduit 98 closed. This mode is used to evacuate vapors from other vessels when transfering liquids from tank 14 into another vessel or tank truck shuttle. As vapors are evacuated as above described, pressure may be released into tank 14 using valves 150, to inject high pressure from tube tank battery 128 through pipe or conduit 92, thereby forcing liquids through valve 82, pipe or conduit 80 and valve 84 into a connecting hose (not shown) connecting the drains of a pair of tanks 14 and tank of other source being evacuated by compresser or gas pump 26, thus transferring liquid with no vapor loss.

With valve 40 in external position and with the compresser 26 inactive, port B of four way valve 40 may be used to pressurize tank 14 from an outside pressure source such as a refinery unloading pressure hose. Such a hose may be connected with port B through valve 148 and into tank 14, thus supplying outside gas pressure to force liquids out of tank 14, through valve 82, pipe or conduit 80 and valve 84 into unloading hose (not shown).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A liquid recovery system for a pressurized gas line including a liquid sump to be evacuated of liquid through a valve controlled liquid discharge line, said system incorporating medium pressure storage tank structure including liquid inlet structure and valved liquid outlet structure as well as vapor outlet structure, gas pump structure including suction and discharge ports, high pressure storage tank structure including gas inlet and gas outlet structure, a first conduit communicating said liquid discharge line with said liquid inlet structure, a second conduit communicating said vapor outlet structure with said suction port, and a third conduit communicating said discharge port with said gas inlet structure.

2. The system of claim 1 wherein said gas pump structure comprises a two-stage compressor having first and second stages with said suction port comprising the inlet port of the first stage and said discharge port comprising the outlet port of the second stage, and a fourth conduit communicating said first stage outlet port and second stage inlet port.

3. The system of claim 2 including a first multiposition valve interposed in said first conduit and a second multiposition valve interposed in said third conduit, a fifth conduit including an inlet end communicated with said gas outlet structure and a valved outlet end for sealed communication with the interior of said gas line, said first and second multiposition valves also being serially connected in said fifth conduit, said first and second multiposition valves being operable to close said first and third conduit and communicate said gas outlet structure with said valved outlet end.

4. The system of claim 3 including a third multiposition valve serially connected in said second conduit and including intake and discharge ports, said third valve multiposition being operable to selectively cut off communication between the upstream and downstream portions of said second conduit on opposite sides of said third multiposition valve and to alternately communicate said intake port with said downstream portion and said discharge port with said upstream portion.

5. The system of claim 4 wherein said second conduit includes a liquid/gas separator serially connected therein.

6. The system of claim 5 wherein said fourth conduit includes a heat exchanger serially connected therein.

7. The system of claim 6 wherein said fourth conduit includes second liquid/gas separator means serially connected therein downstream from said heat exchanger structure.

8. The system of claim 7 wherein said third conduit includes heat exchange structure serially connected therein for transferring heat from gas passing through said third means to the liquid contained within said low pressure storage tank structure.

9. The system of claim 8 wherein said liquid/gas separator each include a lower outlet valve.

10. The system of claim 9 wherein said high pressure tank structure includes a lower liquid outlet valve communicated with said first conduit.

11. The system of claim 2 wherein said fourth conduit includes a heat exchanger structure serially connected therein.

12. The system of claim 11 wherein said second conduit includes a liquid/gas separator serially connected therein and said fourth conduit includes second liquid/-gas separator structure serially connected therein downstream from said heat exchanger structure.

13. The system of claim 12 wherein said gas separator structures each include a valved lower liquid outlet means communicated with said first conduit means.

14. The system of claim 13 wherein said high pressure storage tank structure includes a valved lower liquid outlet communicated with said first conduit.

15. The system of claim 12 wherein said third conduit includes heat exchanger structure serially connected therein for transferring heat from gas passing through said third conduit to the liquid contained within said medium pressure storage tank structure.

16. The system of claim 1 wherein said second conduit includes a liquid/gas separator serially connected therein.

* * * * *